US006932627B2

(12) United States Patent
Raff et al.

(10) Patent No.: US 6,932,627 B2
(45) Date of Patent: Aug. 23, 2005

(54) CONNECTING DEVICE FOR IGNITION SYSTEMS OF INTERNAL COMBUSTION ENGINES

(75) Inventors: Dieter Raff, Schwieberdingen (DE); Bernd Schumacher, Vaihingen (DE); Dieter Betz, Vaihingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/433,079

(22) PCT Filed: Oct. 21, 2002

(86) PCT No.: PCT/DE02/03961

§ 371 (c)(1),
(2), (4) Date: Nov. 12, 2003

(87) PCT Pub. No.: WO03/038958

PCT Pub. Date: May 8, 2003

(65) Prior Publication Data

US 2004/0065286 A1 Apr. 8, 2004

(30) Foreign Application Priority Data

Oct. 23, 2001 (DE) ..... 101 52 085

(51) Int. Cl.[7] ..... H01R 13/44
(52) U.S. Cl. ..... 439/125
(58) Field of Search ..... 439/125

(56) References Cited

U.S. PATENT DOCUMENTS

| | | | | |
|---|---|---|---|---|
| 2,987,587 A | * | 6/1961 | Estes | 200/19.38 |
| 4,423,624 A | * | 1/1984 | Dooley et al. | 73/119 A |
| 4,751,430 A | | 6/1988 | Mueller et al. | 315/57 |
| 5,890,473 A | * | 4/1999 | Hammer et al. | 123/635 |

FOREIGN PATENT DOCUMENTS

| | | | |
|---|---|---|---|
| DE | 195 09 793 | | 9/1996 |
| DE | 196 12 508 | | 10/1997 |
| EP | 713 005 | | 5/1996 |
| EP | 0 796 993 | | 9/1997 |
| JP | 60122279 | * | 6/1985 |

* cited by examiner

*Primary Examiner*—Javaid H. Nasri
(74) *Attorney, Agent, or Firm*—Kenyon & Kenyon

(57) ABSTRACT

A connecting means for ignition systems in internal combustion engines is designed such that the connecting means is functionally reliable even under unfavorable operating conditions. The connecting means has, among other things, a first connection for an ignition coil, a second connection for a spark plug, and a covering cap encasing these connections. The covering cap is made of two layers, having an inner casing made of electrically insulating material and an outer casing lying directly on the inner casing, the outer casing being made of an electrically conductive material, which is electrically connected to ground potential. The casings are each made up of a resilient material. The connecting means is for use in the automotive industry.

8 Claims, 2 Drawing Sheets

CONNECTING DEVICE FOR IGNITION SYSTEMS OF INTERNAL COMBUSTION ENGINES

BACKGROUND INFORMATION

European Patent Application No. 713 005 describes how a connecting means for connecting an ignition coil to a spark plug is manufactured through the use of a spark plug connector, an ignition cable, and a spark plug connector. Before the manufacture of the connecting means, these components of the connecting means were separate structural members having their own closing element as casing or covering cap.

This covering cap, for the most part made of a special rubber mixture, is particularly at risk in internal combustion engines of today. Contributing in particular to the stressful conditions is the fact that there is engine encapsulation in today's engines, as a result of which the covering cap undergoes high thermal stress.

Furthermore, deep spark plug recesses that are sealed with recess sealing are implemented in four-valve engines. As a result, a corrosive atmosphere that corrodes the covering cap can build up in the spark plug recess due to lack of air exchange.

Finally, long spark plug lives are prescribed nowadays. In order to still be able to guarantee the full operativeness of the ignition system even at the end of the useful life, there is a tendency towards higher ignition voltages that endanger the electric insulation property of the covering cap through discharge voltages. These discharge voltages or partial discharges occur from the surface of the covering cap to the electrically grounded cylinder head of the internal combustion engine if there are electrically insulating air inclusions or an air gap between the surface of the covering cap and the surface with ground potential.

The aforementioned factors may, individually or in combination, result in a brittleness of the covering cap, and, consequently, to a failure of the connecting means. Since the partial discharges have the greatest influence on the brittleness of the covering cap here, this type of damage should be avoided, in particular.

SUMMARY OF THE INVENTION

The connecting means according to the present invention for ignition systems of internal combustion engines has the advantage over the related art that it avoids the inadequacies mentioned above. This is achieved by configuring the connecting means with a covering cap made of at least two layers, having an inner casing made of electrically insulating material and an outer casing lying directly on the inner casing, the outer casing being made of electrically conductive material and being electrically connected to ground potential. Air inclusions are avoided by putting the outer casing directly on the inner casing. By designing the outer casing out of a conductive material and through contacting with the ground potential, the inner casing, despite the spatial interval by way of the spark plug shaft, is electrically grounded directly to the cylinder head.

With these measures, discharge voltages on the covering caps are effectively prevented so that brittleness of the covering cap no longer occurs and the covering cap remains functionally stable even under unfavorable operating conditions.

In accordance with an embodiment of the present invention, the outer casing is flexibly arranged on the inner casing so that the connecting means may widen in the region of the connections for contacting without having to change its electrical properties in the process.

In accordance with another embodiment of the present invention, a possibility is shown in which no considerable volume enlargement of the connecting means occurs as a result of positioning the outer casing.

DETAILED DESCRIPTION

Figure 1:
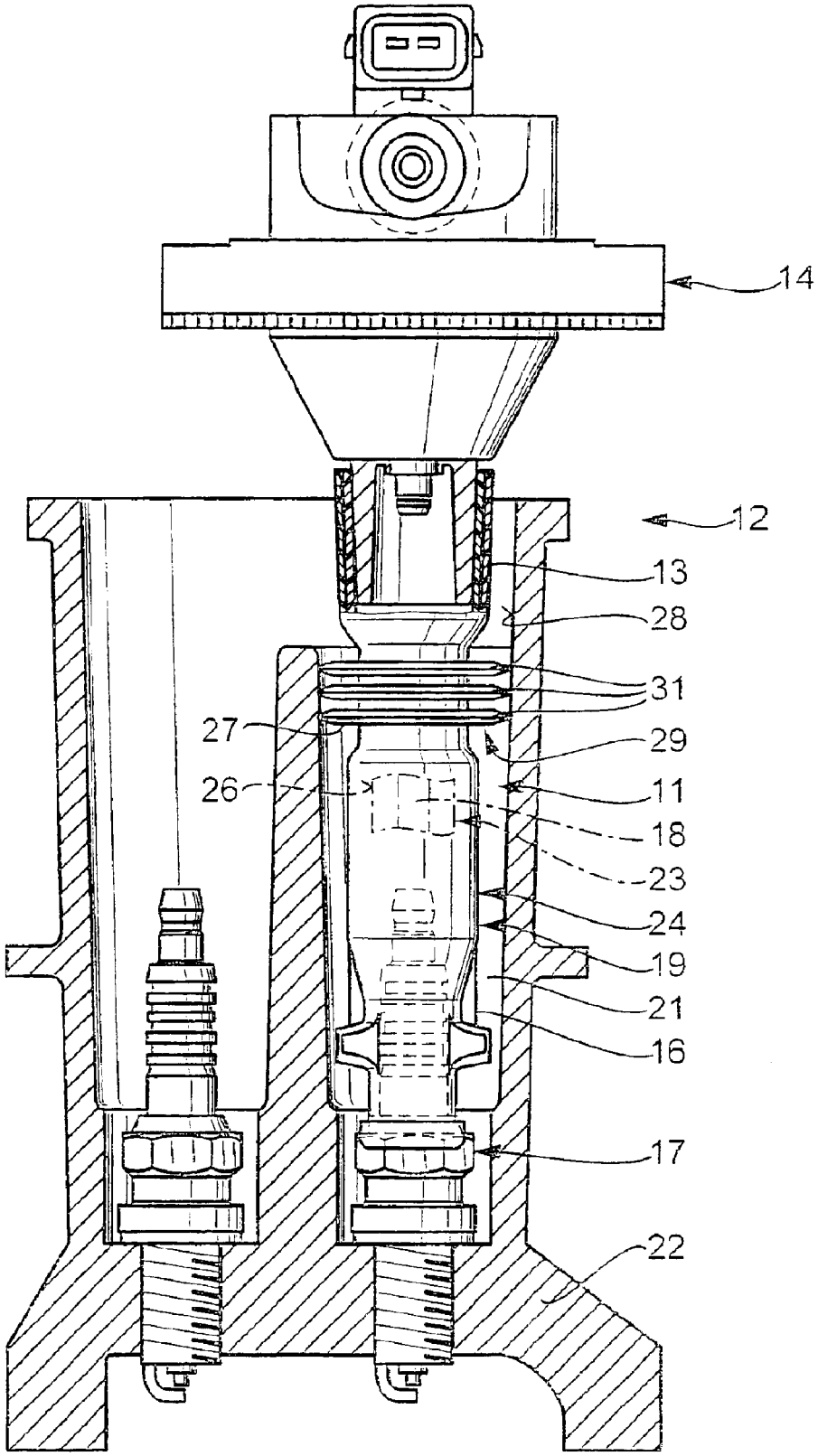
FIG. 1 shows the connecting means each time in sections with parts of an ignition system and at its installation location.

A connecting means 11 for ignition systems of internal combustion engines 12 exhibits, as shown in FIG. 1, the following main features: a first connection 13 for an ignition coil 14, a second connection 16 for a spark plug 17, an electric conductor 18 connecting the two connections 13, 16, shown only by way of intimation, and a covering cap 19 at least partially encasing connections 13, 16, as well as conductor 18.

Connecting means 11 is positioned in shaft 21, also referred to as a spark plug recess, in a cylinder head 22 of internal combustion engine 12. Spark plug 14 is recessed and mounted in a fixed position in a known manner in shaft 21.

Figure 2:
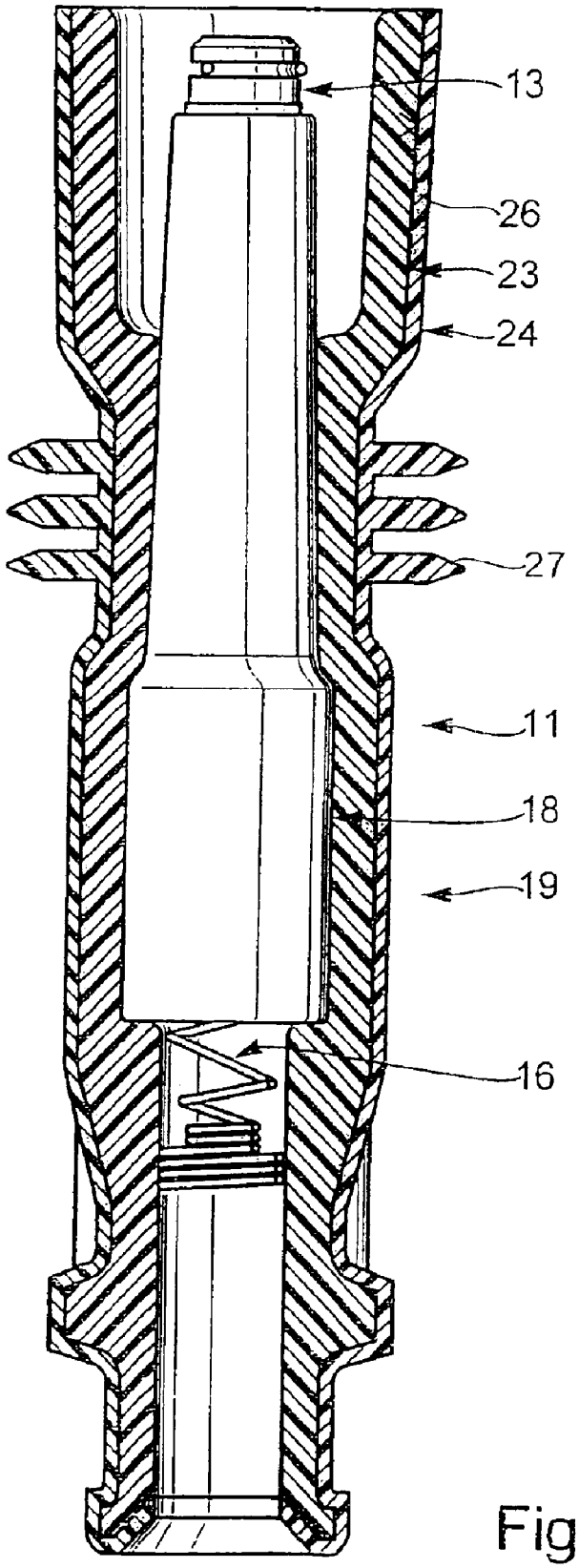
FIG. 2 shows the connecting means, as an individual component.

As shown in FIG. 2, covering cap 19 exhibits an inner casing 23 and an outer casing 24 facing connections 13 and conductor 18, the outer casing directly connecting in radial direction to inner casing 23 without clearance.

Inner casing 23 is made up of an electrical insulating material, preferably out of elastomer having a silicone base. An elastic synthetic in the style of a thermoplastic elastomer would also be possible. In an operating cycle in injection molding, inner casing 23 is applied with a film thickness of approximately 3 mm to connections 13, 16 provided as inserts in an injection molding die and connected to conductor 18. Inner casing 23 rises above the frontal openings of connections 13, 16 in a sleeve-shaped manner. As a result, mating connectors of ignition coil 14 and spark plug 17, which are connected to connections 13, 16, are partially enclosed and sealed.

Outer casing 24 is placed without clearance on exterior 26 of inner casing 23. Like inner casing 23, outer casing 24 is flexible so that when inserting connecting means 11 into the mating connector of ignition coil 14 and spark plug 17, it may expand resiliently and the connection with inner casing 23 remains unchanged in the process.

In contrast to inner casing 23, outer casing 24 is electrically conductive, however. In its longitudinal course, adjacent to first connection 13, it exhibits three axially spaced sealing rings 27 arranged parallel to one another, whose cross-sectional areas toward the free ends taper until the free ends are bendable.

Sealing rings 27 are dimensioned in their radial extension such that when inserting connecting means 11 into shaft 21, they rest on interior 28 of shaft 21 with a slight overdimension and form a shaft sealing 29 as well as electrical contact points 31 to cylinder head 22 of internal combustion engine 12 connected to ground potential.

Outer casing 24 is preferably made of an electrically conductive elastomer having a silicone base, directly spraypainted on exterior 26 of inner casing 23, thereby forming a continuous material connection between casings 23, 24.

Alternatively, outer casing 24 may also be formed through a taut, stretchable and resilient braided screen made of electrically conductive metal on exterior 26.

It is also possible to form outer casing 24 out of a heat-shrinkable sleeve, a thin-walled plastic pipe, or the like.

At any rate, it is important for the function of outer casing 24 for this to be made of an electrically conductive material and, like inner casing 23, to be stretchable and resilient in its mechanical properties. The conditions that the inner, direct connection between casings 23, 24 survives even when inserting connecting means 11 are consequently provided.

Through the electrically conductive outer casing 24, exterior 26 of inner casing 23, as external terminating layer of the electrical insulator of connecting means 11, is electrically connected directly to ground potential of cylinder head 22 of internal combustion engine 12 so that intermediate insulating layers, such as an air gap, do not occur on this electric circuit.

Consequently, electrical partial discharges may no longer develop on connecting means 11 while operating the ignition system, so covering cap 19 is protected from brittleness due to electrical influences, and in this respect, connecting means 11 remains functionally stable even under unfavorable operating conditions.

What is claimed:

1. A connecting device for an ignition system of an internal combustion engine comprising:

a first connection for an ignition coil;

a second connection for a spark plug;

a conductor electrically connecting the first and second connections;

a covering cap at least partially encasing at least one of the first connection, the second connection and the conductor, the covering cap including at least two layers, the covering cap including an inner casing and an outer casing lying directly on the inner casing, the inner casing facing at least one of the first connection, the second connection and the conductor, the inner casing being composed of an electrically insulating material, the outer casing being composed of an electrically conductive material and being electrically connected to ground potential; and a shaft sealing, an electrical connection of the outer casing to ground potential taking place by way of the shaft sealing situated at the outer casing.

2. The connecting device according to claim 1, wherein the outer casing is flexibly situated on the inner casing, the inner casing composed of an elastomer.

3. The connecting device according to claim 2, wherein the outer casing is applied to the inner casing as a spray coating.

4. The connecting device according to claim 3, wherein the outer casing includes an elastomer.

5. The connecting device according to claim 2, wherein the outer casing includes a braided screen composed of metal.

6. The connecting device according to claim 2, wherein the outer casing includes a heat-shrinkable sleeve.

7. The connecting device according to claim 1, wherein the covering cap at least partially encases the first connection, the second connection, and the conductor.

8. A connecting device for an ignition system of an internal combustion engine comprising:

a first connection for an ignition coil;

a second connection for a spark plug;

a conductor electrically connecting the first and second connections;

a covering cap at least partially encasing at least one of the first connection, the second connection and the conductor, the covering cap including at least two layers, the covering cap including an inner casing and an outer casing lying directly on the inner casing, the inner casing facing at least one of the first connection, the second connection and the conductor, the inner casing being composed of an electrically insulating material, the outer casing being composed of an electrically conductive material and being electrically connected to ground potential; and a shaft sealing situated at the outer casing and configured to seal a recess in a cylinder head of the internal combustion engine, the electrical connection of the outer casing to ground potential taking place by way of the shaft sealing.

* * * * *